US006307321B1

(12) United States Patent
Honda et al.

(10) Patent No.: US 6,307,321 B1
(45) Date of Patent: Oct. 23, 2001

(54) HIGH-PRESSURE DISCHARGE LAMP AND LIGHTING APPARATUS

(75) Inventors: Hisashi Honda; Seiji Ashida, both of Yokosuka (JP)

(73) Assignee: Toshiba Lighting & Technology Corporation, Tokyo (JP)

( * ) Notice: Subject to any disclaimer, the term of this patent is extended or adjusted under 35 U.S.C. 154(b) by 0 days.

(21) Appl. No.: 09/532,331

(22) Filed: Mar. 21, 2000

Related U.S. Application Data

(63) Continuation of application No. PCT/JP99/03797, filed on Jul. 14, 1999.

(51) Int. Cl.[7] ..... H01J 61/88

(52) U.S. Cl. ..... 313/634; 313/638; 313/570; 313/573

(58) Field of Search ..... 313/634, 638, 313/570, 573, 620

(56) References Cited

U.S. PATENT DOCUMENTS 5,097,176 * 3/1992 De Hair et al. ..... 313/634 X
5,424,609 * 6/1995 Geven et al. ..... 313/634 X
5,497,049 * 3/1996 Fischer ..... 313/634
5,654,608 * 8/1997 Westemeyer et al. ..... 313/634

FOREIGN PATENT DOCUMENTS

0156383A2 10/1985 (EP) .
0841687A2 5/1998 (EP) .
0935278A1 8/1999 (EP) .
6-196131 7/1994 (JP) .
10-172508 6/1998 (JP) .

* cited by examiner

*Primary Examiner*—Ashok Patel
(74) *Attorney, Agent, or Firm*—Christensen O'Connor Johnson Kindness PLLC

(57) ABSTRACT

The high-pressure discharge lamp of the present invention comprises a light-transmitting ceramic discharge vessel (1), power-supplying conductors (2), a pair of electrodes (3, 3), seals (4) made of ceramic-sealing compound, and a discharge medium. The discharge vessel has an inner volume of 0.1 cc or less. The distal ends of the electrodes are arranged so as to maintain a distance d1 of 1.0 mm or more from the inner surface of the light-transmitting vessel on a plane which is perpendicular to the axis of the light-transmitting vessel and includes the distal ends of the electrodes.

6 Claims, 3 Drawing Sheets

HIGH-PRESSURE DISCHARGE LAMP AND LIGHTING APPARATUS

CROSS-REFERENCE TO RELATED APPLICATIONS

This is a continuation of Application No. PCT/JP99/03797, filed Jul. 14, 1999.

This application is based upon and claims the benefit of priority from the prior Japanese Patent Application No. 10-210120, filed Jul. 24, 1998.

BACKGROUND OF THE INVENTION

The present invention relates to a high-pressure discharge lamp that has a discharge vessel made of light-transmitting ceramic, and a lighting apparatus that uses the lamp.

There is a demand for a high-pressure discharge lamp having a smaller lamp power of 20 W or less, which is made of light-transmitting ceramic and which has a long lifetime and a high efficiency.

It was found that a leak occurs at the seal shortly after the lamp is turned on even if a small high-pressure discharge lamp is manufactured by proportionally reducing directly the specifications of the discharge vessel and electrodes of a conventional, relatively large, high-pressure lamp to meet the demand. This is because the modes of conveying heat to the seal from a heat source such as discharge plasma, i.e., heat conduction, convection and radiation, are unbalanced.

To realize small high-pressure discharge lamps, the prior art technology of high-pressure discharge lamps should therefore be reviewed fundamentally to create new specifications that are suitable for small, high-pressure discharge lamps.

In contrast, the present inventors have already invented a high-pressure discharge lamp comprising light-transmitting ceramic that has a desirable long lifetime and a preferable light-emission efficiency even with a small size. That invention has already been filed as Japanese Patent Application No. 10-196322. The invention according to this application discloses a light-transmitting ceramic discharge vessel comprising a bulging section having both ends narrowed by continuous curved surfaces, and small-diameter cylindrical sections communicating with the ends of the bulging section and having an inner diameter smaller than the bulging section. It is very advantageous for a small high-pressure discharge lamp to use this discharge vessel because the discharge vessel can be formed integral with ease and has no optically and thermally discontinuous portion.

It was found, however, a problem occurs depending on the size of the space in the bulging section around the electrodes in the light-transmitting ceramic discharge vessel having the shaped as described above. That is, when a high-pressure discharge lamp which has been lightened is turned off, vapor of fillings such as a halide and mercury which has been dispersed in the discharging space moves toward narrow gaps in the small-diameter cylindrical sections of the light-transmitting ceramic discharge vessel having a low temperature. At this time, a turbulent flow is generated around the electrodes. If a turbulent flow is generated, the fillings such as halide and mercury easily adhere to surfaces of distal ends of the electrodes. Once the fillings have adhered to the distal ends of the electrodes, the electric discharging power attenuates so operation errors are caused at starting or transition from a glow discharge to an arc discharge becomes difficult. As a result, sputtering is excited and blackening occurs in the light-transmitting ceramic discharge vessel due to the sputtering.

BRIEF SUMMARY OF THE INVENTION

The first object of the present invention is to provide a small, high-pressure discharge lamp which starts steadily.

The second object of the present invention is to provide a small, high-pressure discharge lamp which easily transits from glow discharge to arc discharge.

The third object of the present invention is to provide a small, high-pressure discharge lamp in which the light-transmitting ceramic discharge vessel is prevented from blackening due to sputtering.

The forth object of the present invention is to provide a lighting apparatus using the above described small, high-pressure discharge lamp.

The first high-pressure discharge lamp according to this invention is characterized by comprising: a light-transmitting ceramic discharge vessel having an internal volume of 0.1 cc or less and including a bulging section and small-diameter cylindrical sections communicating with both ends of the bulging section, the bulging section having both ends narrowed by a continuous curved surface, and the small-diameter cylindrical sections having an inner diameter smaller than the bulging section; power-supplying conductors each including a seal part and a halide-resistant section having a proximal end connected to a distal end of the seal part and inserted respectively in the small-diameter cylindrical sections of the light-transmitting ceramic discharge vessel, each of the halide-resistant sections forming a slight gap to the inner surface of the small-diameter cylindrical section; a pair of electrodes respectively arranged at the distal ends of one halide-resistant parts and located in the bulging section of the light-transmitting ceramic discharge vessel, with a distance d1 of 1.0 mm or above maintained between each of distal ends of the electrodes and the inner surface of the light-transmitting ceramic discharge vessel on a plane perpendicular to an axis of the light-transmitting ceramic discharge vessel including the distal ends of the electrodes; seals made of ceramic-sealing compound respectively making sealing between the small-diameter cylindrical sections of the light-transmitting ceramic discharge vessel and the seal parts of the power-supplying conductors; and a discharge medium containing metallic halide and filled in the light-transmitting ceramic discharge vessel.

In the present invention and each invention described below, the terms are defined to have the following technical meanings, unless otherwise specified:

(Light-transmitting Ceramic Discharge Vessel) "Light-transmitting ceramic discharge vessel" means a discharge vessel made of light-transmitting and heat-resistant materials. Among these materials are: a single-crystal metallic oxide such as sapphire; a polycrystalline metallic oxide such as translucent, airtight aluminum oxide, yttrium-aluminum garnet (YAG) or yttrium oxide; and a polycrystalline non-oxide such as aluminum nitride (AIN). The term "light-transmitting" is used in the sense that the light generated by discharge may be guided to the outside, passing through the discharge vessel. It may mean either transparency or light-diffusing property.

To manufacture the light-transmitting ceramic discharge vessel, the bulging section, or center section, and the small-diameter cylindrical sections connected to the ends of the bulging section is preferably formed integral first. Otherwise, the light-transmitting ceramic discharge vessel can be also formed in a manner that the bulging section is molded preliminarily with the both ends narrowed by a continuous curved surface integrally, and then a pair of small-diameter cylindrical sections preliminarily molded are fitted in the distal ends of the bulging section respectively and sintered.

The internal volume of the light-transmitting ceramic discharge vessel is defined to 0.1 cc or less because the present invention relates to the small, high-pressure discharge vessel.

The internal volume of the light-transmitting ceramic discharge vessel is measured in the following manner: the discharge vessel is put in water to fill the inside with water; opening ends of the small-diameter cylindrical section provided at the both ends of the discharge vessel are closed; the discharge vessel is taken out of water; and then water contained in the discharge vessel is measured.

(Power-Supplying Conductors)

The Power-Supplying conductor is provided to at least one of the small-diameter cylindrical section of the light-transmitting ceramic discharge vessel.

"Power-Supplying conductors" serve to supply power from a power supply through a ballast means, thus applying a voltage between the electrodes to start the high-pressure discharge lamp, and supplying a current to light the high-pressure discharge lamp. They are sealed airtightly to the small-diameter cylindrical sections by the means that will be described later.

The power-supplying conductors each have a seal part and a halide-resistant part.

"Seal part" is made of such material that the junction between it and the small-diameter cylindrical section may be sealed by the seal made of ceramic-sealing compound, which will be described later. "Seal part" is sealed to the junction between the small-diameter cylindrical section and the seal part of the power-supplying conductor through a ceramic tube. The seal part of the power-supplying conductor can be made of niobium, tantalum, titanium, zirconium, hafnium, or vanadium. As a characteristic of the seal part, it does not matter whether the seal part allows passage of hydrogen and oxygen or not. These materials, however, exhibit permeability to hydrogen and oxygen. If aluminum oxide is used, it is desirable that the seal part be made of niobium or tantalum, because niobium and tantalum have average thermal expansion coefficients, which are almost equal to those of aluminum oxide. Niobium and tantalum have average thermal expansion coefficients, which differ only a little from those of yttrium oxide and YAG. If aluminum nitride is used as the material of the light-transmitting ceramic discharge vessel, the seal part should better be made of zirconium.

"Halide-resistant part" is made of material that is hardly corroded or is not corroded at all by the halide and liberated halogen present in the light-transmitting ceramic discharge vessel, while the high-pressure discharge lamp is operating. The halide-resistant part is made of, for example, tungsten or molybdenum. In the case that the distal of the halide-resistant part extends into the light-transmitting ceramic discharge vessel and forms an electrode part, tungsten which excels in heat resistance is most preferred for the halide-resistant part. The high-pressure discharge lamp according to the present invention can be either an AC-driven lamp or a DC-driven lamp. In the case of an DC-driven, high-pressure discharge lamp, anodes which are formed separately may be connected to the tips of the halide-resistant part of the power-supplying conductor.

A narrow gap is provided between the halide-resistant part and the inner surface of the small-diameter cylindrical section. While the lamp is being lighted, the residual halide in the form of liquid flows into this gap, forming the coldest part. The gap may be adjusted appropriately, thereby to set the coldest part can be set at a desired temperature.

The narrow gap formed between the halide-resistant part and the inner surface of the small-diameter cylindrical section can be provided in each side of both the power-supplying conductors. It suffices that the narrow gap should be provided in at least one side of the power-supplying conductors.

(Electrode)

The electrodes are provided respectively at the distal ends of the halide-resistant parts of the power-supplying conductors. The distance d1, between the distal end of the electrode and the inner surface of the bulging section of the light-transmitting ceramic discharge vessel in the plane perpendicular to the axis of the electrode including its distal end is defined to 1.0 mm or more. Since the electrode may be more or less inclined to the axis of the light-transmitting ceramic discharge vessel in some cases, the average distance around the circumference about the axis of the electrode is taken as the distance.

The distance d1 can be securely maintained around the electrode by one or both of a measure in which the length of the projection of the electrode projected into the bulging section of the discharge vessel is increased and a method in which a portion of the light-transmitting ceramic discharge vessel facing the electrode is enlarged.

Further, the distal end of the halide-resistant part of the power-supplying conductor is projected to the inside of the bulging section of the light-transmitting ceramic discharge vessel, so that the electrodes can be formed integral with the power-supplying conductor. In this structure, the halide-resistant part of the power-supplying conductor can be formed of a tungsten bar. As a result, functionally, the power-supplying conductor and the electrode can be formed with the seal part and the above described tungsten bar, therefore, the structure of the power-supplying conductor and the electrode can be simplified and downsized.

In the present invention, it is also possible that the power-supplying conductor and the electrode are formed individually and the electrode is connected to the distal end of the halide-resistant part of the power-supplying conductor.

(Seal Made of Ceramic-Sealing Compound)

The seal made of ceramic-sealing compound is applied to the end of each small-diameter cylindrical section, between the seal part and the small-diameter cylindrical section. While the small-diameter cylindrical section is melted by heat, ceramic-sealing compound is flowed into the gap between the seal part and the small-diameter cylindrical section, and seals the seal part and the section in airtight fashion. The seal secures the power-supplying conductor at a predetermined position.

It is desired that the seal part inserted in the small-diameter cylindrical section should be completely covered with the above-mentioned ceramic-sealing compound. Moreover, the proximal portion of the halide-resistant part, which is connected to the seal part, may also be covered with the seal over a short distance. If so, the seal part will hardly be corroded by halide.

(Discharge Medium)

The discharge medium contains a metallic halide. The metal includes at least a light-emitting metal.

The halogen forming the metallic halide can be one or more selected from the group consisting of iodine, bromine, chlorine and fluorine.

The halide of light-emitting metal can be selected from the known metallic halides in accordance with the size and input power of the light-transmitting ceramic discharge vessel, so as to acquire desired luminescent characteristics, such as luminous color, general color rendering index Ra, luminous efficiency, and the like. The halide may be one or more selected from the group of halides of, for example, sodium Na, lithium Li, scandium Sc, and rare-earth metal.

Mercury can be contained, as a buffer medium, in an appropriate amount. Instead of mercury, a halide of metal such as aluminum, which has a relatively high vapor pressure and which emits a small amount of light in the visible-light region or does not emit light at all, may be contained in the vessel.

Argon, xenon, neon, and the like can be used as rare gas.

(Other Structure)

In general, rated electric power consumption of 35 W or less is preferred for the high-pressure discharge lamp according to the present invention. In order to further downsize the high-pressure discharge lamp, rated electric power consumption of 20 W or less is preferable.

(Effects of the Present Invention)

In the high-pressure discharge lamp according to the present invention, a sufficient space can be maintained around the distal ends of the electrodes by using the above described structure. As a result, when vapor of fillings coheres to the narrow gaps as the coldest parts present in the small-diameter cylindrical sections of the light-transmitting ceramic discharge vessel while the lamp being lighted, a turbulent flow can be prevented from occurring around the electrodes. Even if the turbulent flow is generated, it can be suppressed to a very low degree. Therefore, the fillings can not easily adhere to the distal ends of the electrodes, so lowering of the electric discharging performance of the electrodes is prevented. As a result, deterioration of starting characteristic caused by the lowering of the electric discharging performance of the electrodes can be prevented.

In this respect, it has been confirmed by experimentations that if the distance d1 is less than 1.0 mm, a turbulent flow can be easily generated around the electrodes when the light is turned off.

The second high-pressure discharge lamp of the present invention which depends on the first high-pressure discharge lamp is characterized in that: the distance d1 between each of distal ends of the electrodes and the inner surface of the light-transmitting ceramic discharge vessel on a plane perpendicular to an axis of the light-transmitting ceramic discharge vessel including the distal ends of the electrodes is 1.2 mm or more.

The second high-pressure discharge lamp has more appropriate efficiency than the first high-pressure discharge lamp.

The third high-pressure discharge lamp according to the present invention is characterized by comprising: a light-transmitting ceramic discharge vessel having an internal volume of 0.1 cc or less and including a bulging section and small-diameter cylindrical sections communicating with both ends of the bulging section, the bulging section having both ends narrowed by a continuous curved surface, and the small-diameter cylindrical sections having an inner diameter smaller than the bulging section; power-supplying conductors each including a seal part and a halide-resistant section having a proximal end connected to a distal end of the seal part and inserted respectively in the small-diameter cylindrical sections of the light-transmitting ceramic discharge vessel, each of the halide-resistant sections forming a slight gap to the inner surface of the small-diameter cylindrical section; a pair of electrodes respectively arranged at the distal ends of one halide-resistant parts and having distal ends projected by 1.2 mm or more into the bulging section of the light-transmitting ceramic discharge vessel; seals made of ceramic-sealing compound respectively making sealing between the small-diameter cylindrical sections of the light-transmitting ceramic discharge vessel and the seal parts of the power-supplying conductors; and a discharge medium containing metallic halide and filled in the light-transmitting ceramic discharge vessel.

In the present invention, the length of the projection of the electrode projected into the bulging section is defined as follows. The length of the bulging section is the distance between cross-points where the axis of the light-transmitting ceramic discharge vessel crosses lines which are tangent to inner surfaces of the small-diameter cylindrical sections in both end sides and are extended from the center of the inner surface of the bulging section. Therefore, the length of the small-diameter cylindrical section is given by measuring the size from the center of the bulging section to an end surface of a small-diameter cylindrical section and further subtracting the half of the length of the bulging section from the size.

As a result, the projecting length of the distal end of the electrode is equal to the distance from the end of the bulging section to the distal end of the electrode.

In this present invention, by defining the projecting length of the electrode projected into the bulging section of the light-transmitting ceramic discharge vessel, a turbulent flow around the electrodes can be suppressed when the lamp is turned off. That is, by defining the projecting length as described above, a sufficient space is maintained around the electrodes so that the turbulent flow can not be generated when turning off the lamp or can be suppressed to a very low degree even if a turbulent flow is generated.

Accordingly, the fillings hardly adheres to the electrodes and thus the starting characteristic can be improved.

In contrast, it has been confirmed by experimentation that if the projecting length of the distal end of the electrode is less than 1.2 mm, a sufficient space can not be maintained around the electrodes and the starting characteristic also can not be improved.

The fourth high-pressure discharge lamp according to the present invention is characterized by comprising: a light-transmitting ceramic discharge vessel having an internal volume of 0.1 cc or less and including a bulging section and small-diameter cylindrical sections communicating with both ends of the bulging section, the bulging section having both ends narrowed by a continuous curved surface, and the small-diameter cylindrical sections having an inner diameter smaller than the bulging section; power-supplying conductors each including a seal part and a halide-resistant section having a proximal end connected to a distal end of the seal part and inserted respectively in the small-diameter cylindrical sections of the light-transmitting ceramic discharge vessel, each of the halide-resistant sections forming a slight gap to the inner surface of the small-diameter cylindrical section; a pair of electrodes respectively arranged at the distal ends of one halide-resistant parts and having distal ends projected by 1.2 mm or more into the bulging section of the light-transmitting ceramic discharge vessel, with a distance d1 of 1.0 mm or more maintained between each of distal ends of the electrodes and the inner surface of the light-transmitting ceramic discharge vessel on a plane perpendicular to an axis of the light-transmitting ceramic discharge vessel including the distal ends of the electrodes; seals made of ceramic-sealing compound respectively making sealing between the small-diameter cylindrical sections of the light-transmitting ceramic discharge vessel and the seal parts of the power-supplying conductors; and a discharge medium containing metallic halide and filled in the light-transmitting ceramic discharge vessel.

This invention defines the length of the projection of the distal end of the electrode projected into the bulging section and the distance between the distal end of the electrode and the inner surface of the discharge vessel in the plane perpendicular to the axis of the light-transmitting ceramic discharge vessel, as above described, thereby to maintain a space around the electrodes.

The fifth high-pressure discharge lamp of the present invention, according to any one of the first to third high-pressure discharge lamps, is characterized in that the light-transmitting ceramic discharge vessel has an inner volume of 0.05 cc or less.

The present invention provides a more remarkable effect in case of a small, high-pressure discharge lamp in which the light-transmitting ceramic discharge vessel has an inner volume of 0.05 or less. The inner volume can be reduced to less than 0.04 cc.

Further, it is effective if the rated lamp power of the high-pressure discharge lamp is set to of 20 W or less.

A lighting apparatus according to the present invention is characterized by comprising: a main body; and any one of the first to fifth high-pressure discharge lamps, supported by the main body.

In the present invention, the lighting apparatus conceptually covers all apparatuses that apply light emission of a high-pressure discharge lamp for any purposes. For example, the present invention is applicable to lighting apparatuses, headlights for mobiles, light sources for optical fibers, image projection apparatuses, photochemical apparatuses, fingerprint identification apparatuses, and the like.

The main body means the other part of the lighting apparatus than the high-pressure discharge lamp.

A preferred example of application of the present invention in addition to the above cases is a bulb type high-pressure lamp. In the present invention, "bulb type high-pressure discharge lamp" means a lighting device which integrally comprises a high-pressure discharge lamp, a discharge lamp lighting device, and a power-receiver means such as a base and which can be turned on by merely setting it in a lamp socket for an incandescent lamp, like a bulb-type fluorescent lamp.

Since the present invention uses a small, high-pressure discharge lamp which has a small light-emitting section and can easily control light, a reflector should preferably be comprised integrally when forming a bulb-type discharge lamp.

In this case, it is possible to attain a down light which can be directly attached to a lighting tool for a down light or so with an excellent light-transmitting distribution characteristic and which provides a high color temperature.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

A first embodiment of the high-pressure discharge lamp according to the present invention will be explained with reference to FIGS. 1 and 2.

Figure 1:
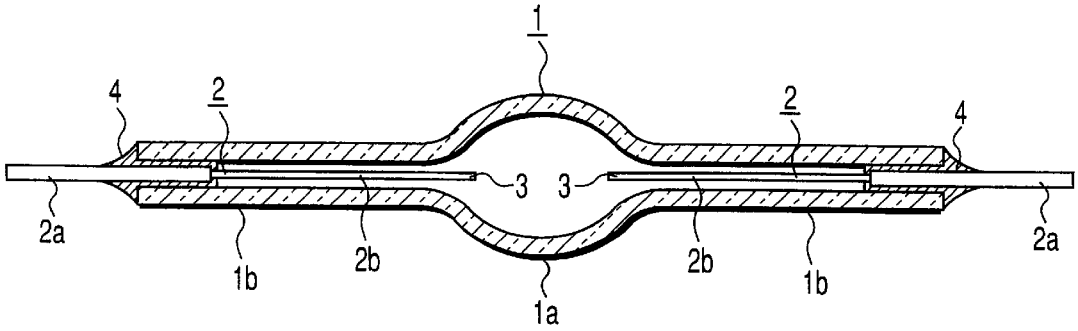
FIG. 1 is a sectional view showing a first embodiment of the high-pressure discharge lamp according to the present invention.
Figure 2:
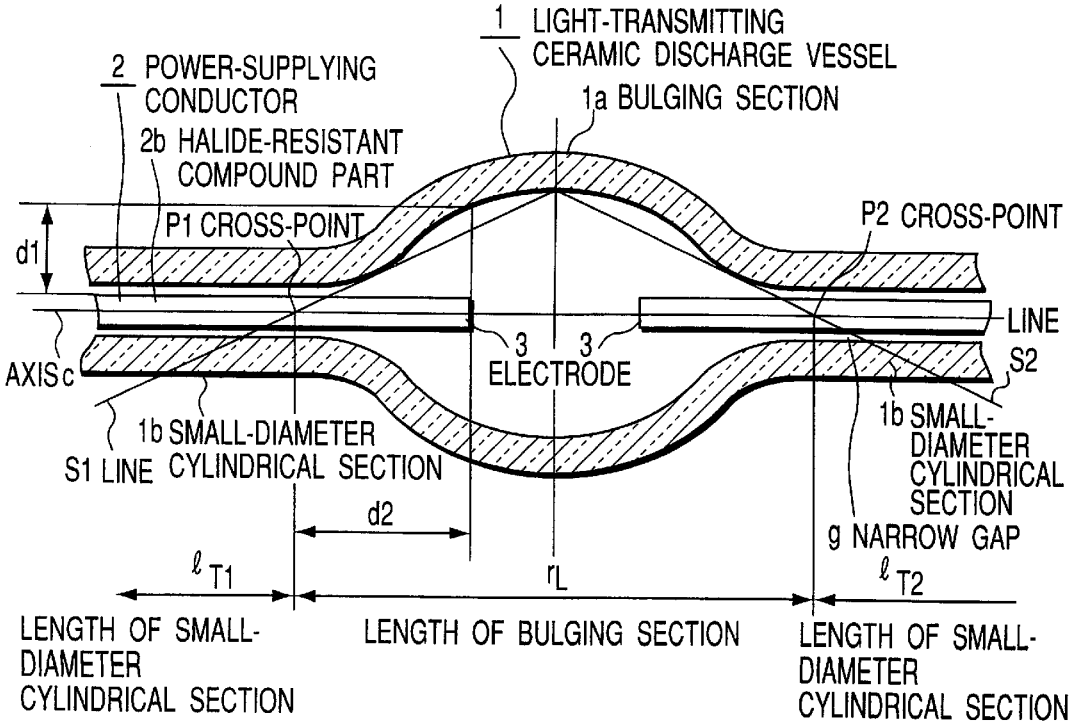
FIG. 2 is an enlarged sectional view of a main part, showing measurement references of respective sections of the light-transmitting ceramic discharge vessel.

In FIGS. 1 and 2, the reference numeral 1 denotes a light-transmitting ceramic discharge vessel. The reference numeral 2 denotes power-supplying conductors. The reference numeral 3 denotes electrodes. The reference numeral 4 denotes seals. The light-transmitting ceramic discharge vessel includes a bulging section 1*a* and small-diameter cylindrical sections. The both ends of the bulging section 1*a* are narrowed by continuous curved surfaces and the bulging section 1*a* is formed into a hollow and substantially elliptic spherical shape. The small-diameter cylindrical section 1*b* is connected to the bulging section through the continuous curved surface, and forms the light-transmitting ceramic discharge vessel 2 by integral molding.

Next, a measurement reference for the bulging section of the light-transmitting ceramic discharge vessel and the small-diameter cylindrical section will be explained with reference to FIG. 2.

Suppose that the length rL of the bulging section 1*a* is the distance between cross-points P1 and P2 where lines s1 and s2 are respectively drawn in the lateral directions from the center of the inner surface of the bulging section 1*a* to be tangent to the inner surface of the bulging section 1*a* in the small-diameter sides.

Meanwhile, the length of the small-diameter section 1*b* in the left side in the figure is defined as the distance lT1 between the end portion of the length rL of the bulging section 1*a* which is the cross-point P1 and the left end surface of the small-diameter cylindrical section (omitted from FIG. 2). Likewise, the length of the small-diameter cylindrical section in the right side in the figure is defined as the distance lT2 between the cross-point P2 and the right end surface of the small-diameter cylindrical section.

Accordingly, the total length of the light-transmitting ceramic discharge vessel can be obtained found by the following equation.

$$lL=rL+lT1+lT2$$

The explanation will further be continued with reference to FIG. 1.

The power-supplying conductor 2 includes a seal part 2*a* and a halide-resistant part 2*b*.

The seal part 2*a* functions when sealing the light-transmitting ceramic discharge vessel 1 between the power-supplying conductor 2 and the small-diameter cylindrical section 1*b*. The halide-resistant part 2*b* has a proximal end welded to the tip of the seal part 2*a* and a distal end projected into the bulging section 1*a*. Further, a small gap is formed between the part 2*b* and the inner surface of the small-diameter cylindrical section as shown in FIG. 2. The electrode 3 is connected to the halide-resistant part 2*b* and is constructed to be integral with the power-supplying conductor 2.

The dimensional relation between the distal end of the electrode 3 and the inner surface of the bulging section 1*a* will be explained again with reference to FIG. 2.

Where d1 is the distance between the distal end of the electrode 3 and the inner surface of the light-transmitting ceramic discharge vessel 1 on a plane perpendicular to the axis c of the light-transmitting ceramic discharge vessel 1 including the distal end, this d1 is set to 1.0 mm or above.

In addition, the projection length d2 by which the electrode 3 projects from the bulging section 1*a* of the light-transmitting ceramic discharge vessel 1 is set to 1.2 mm or above.

A seal 4 is inserted between the small-diameter cylindrical section 1*b* and the seal part 2*a* to seal airtightly the light-transmitting ceramic discharge vessel 1 and fixes the power-supplying conductor 2 to a predetermined position. To form the seal 4, a ceramic-sealing compound is applied around the seal part 2*a* of the power-supplying conductor 2 and is heated and melted to enter into the narrow gap between the seal part 2*a* and the inner surface of the small-diameter cylindrical section 1*b*. Further, the whole of the seal part 2*a* inserted in the small-diameter cylindrical section 1*b* is covered with the ceramic-sealing compound, and the proximal end of the halide-resistant section 2*b* is further covered as well.

A discharge medium containing a metallic halide of light-emitting metal and a rare gas is filled in the light-transmitting ceramic discharge vessel.

The high-pressure discharge lamp shown in FIG. 1 is specified as follows.

The light-transmitting ceramic discharge vessel is made of YAG and has the bulging section 1*a* having a length of 6 mm long and thickness of 0.5 mm, and the small-diameter cylindrical section 1*b* having an outer diameter of 1.8 mm and a total length being 35 mm.

In the power-supplying conductor, the seal part 2*a* is a niobium bar having an outer diameter of 0.64 mm, and the halide-resistant section 2*b* (the electrode as well) is a tungsten bar having an outer diameter of 0.3 mm.

The discharge medium contains 0.6 mg of, 0.6 mg of TlI, 0.4 mg InI and mercury 5 mg, and approximately 20 kPa of argon is filled as a relaxation gas.

Next, the length of the projection d2 of the electrode projected into the bulging section of the light-transmitting ceramic discharge vessel is set to 2 mm, and twenty high-pressure discharge lamps are manufactured, wherein the distance d1 between the distal of the electrode and the inner surface of the light-transmitting ceramic discharge vessel is changed within and beyond the scope of the present invention. The following Table 1 shows a result of comparing the probabilities of starting errors thereof using a discharge lamp lighting circuit (non-loaded secondary voltage: 4.5 kV).

TABLE 1

| Distance d1 (mm) | Starting Error Probability (%) |
|---|---|
| 0.4 | 100 |
| 0.6 | 95 |

TABLE 1-continued

| Distance d1 (mm) | Starting Error Probability (%) |
|---|---|
| 0.8 | 55 |
| 1.0 | 0 |
| 1.2 | 0 |
| 1.4 | 0 |

Figure 3:
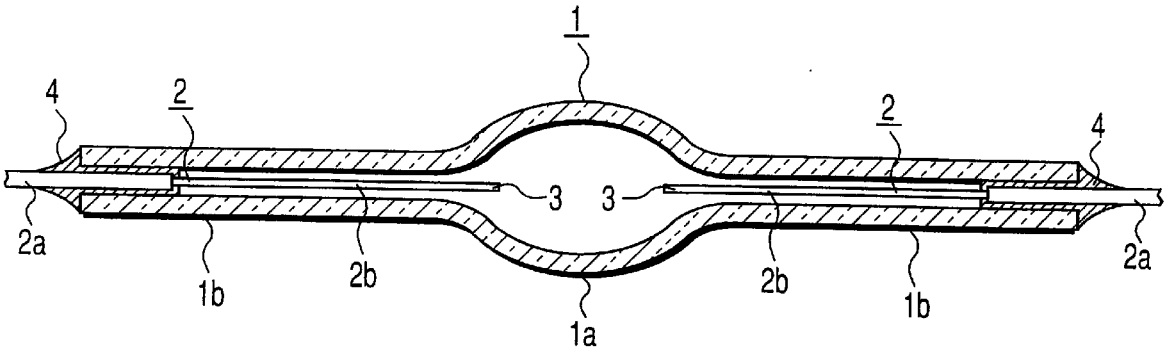
FIG. 3 is a sectional view showing a second embodiment of the high-pressure discharge lamp according to the present invention.

FIG. 3 is a sectional view showing a second embodiment of the high-pressure discharge lamp according to the present invention. In FIG. 3, the same parts as those in FIG. 1 are designated at the same reference numerals as those used to designate the same parts, and detailed description of those parts will be omitted herefrom.

The present embodiment differs from the first embodiment in that the bulging section 1*a* of the light-transmitting ceramic discharge vessel 1 is formed into an elliptical spherical shape to enlarge the distance between the electrodes relatively.

Figure 4:
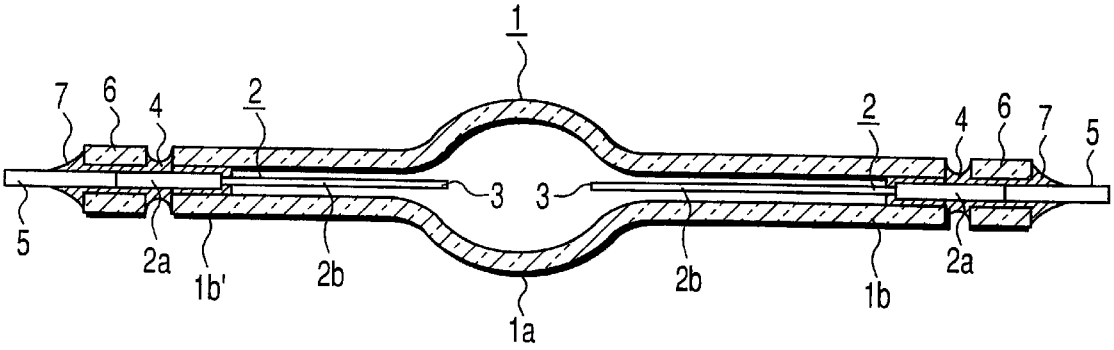
FIG. 4 is a sectional view showing a third embodiment of the high-pressure discharge lamp according to the present invention.

FIG. 4 is a sectional view showing a third embodiment of the high-pressure discharge lamp according to the present invention. In the figure, the same parts as those in FIG. 1 are designated at the same reference numerals as those in FIG. 1, and detailed description of those parts will be omitted herefrom.

The present embodiment is different in that the high-pressure discharge lamp is not sealed in an outer tube but is constructed in a structure suitable for lighting.

That is, the seal part 2*a* of the power-supplying conductor is not structured to be exposed in the air, because the seal part 2*a* of the power-supplying conductor can be easily oxidized. A platinum bar 5 is welded to the end of the seal part 2*a* and the first seal 4 is formed. Thereafter, a ceramic tube 4 is engaged on the portion of the seal part 2*a* which is exposed to the outside from the seal 4. A ceramic-sealing compound is applied to the end of the ceramic tube 5 and is melted with heat to form a second seal 7.

The seal part 1*a* positioned outside the light-transmitting ceramic discharge vessel 1 is coated airtightly by the ceramic tube 6 and the second seal 7 so that the high-pressure discharge lamp can be lighted in the air without sealing it air-tightly in the outer tube.

Further, the length of the small-diameter cylindrical section differs between the sections 1*b* and 1*b*' in the present embodiment.

Figure 5:
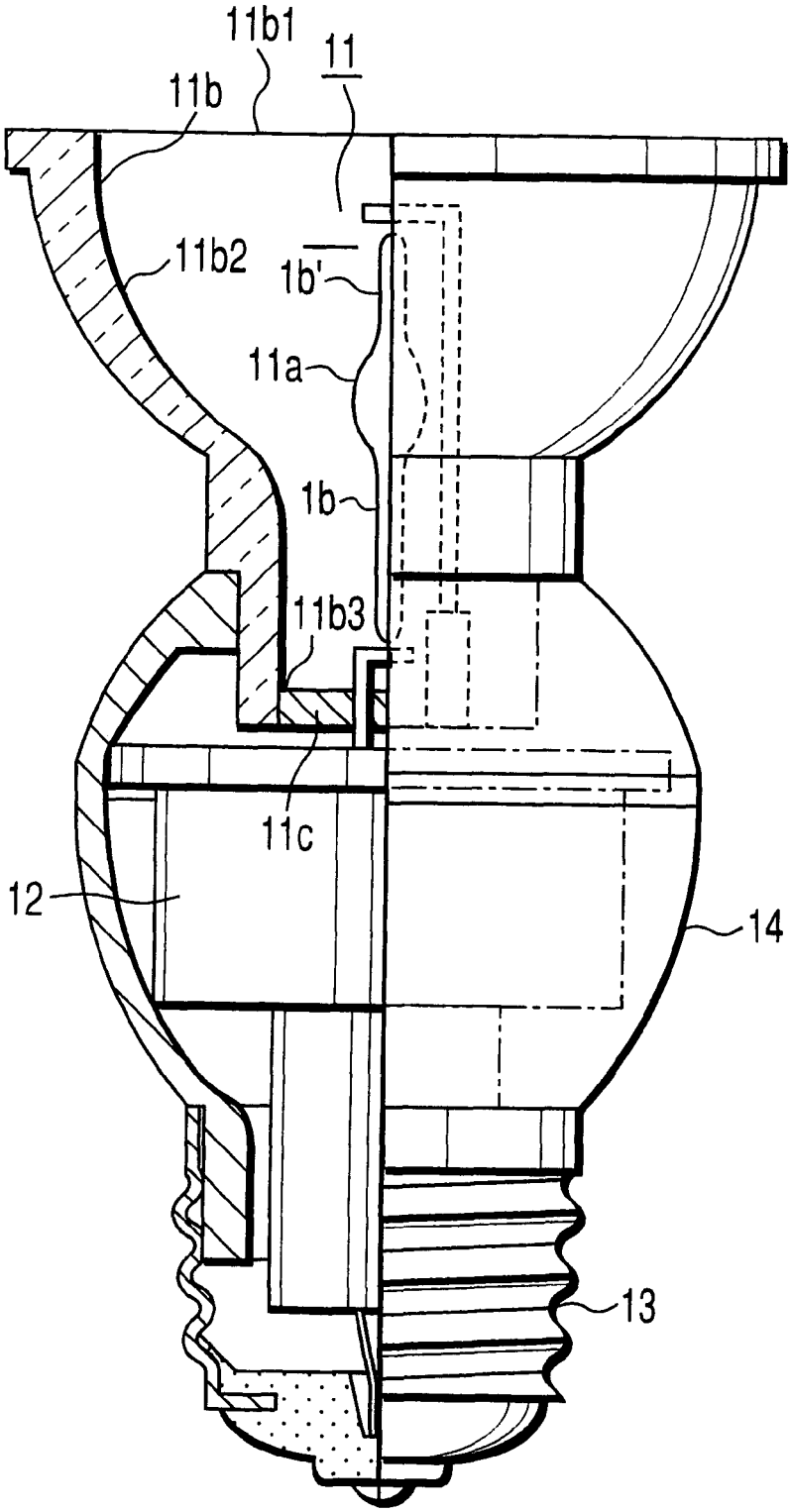
FIG. 5 is a front view of a bulb type high-pressure discharge lamp as an embodiment of the lighting apparatus according to the present invention, partially showing a cross-section thereof.

FIG. 5 is a partially cutaway central front view showing a bulb type high-pressure discharge lamp as an embodiment of a lighting apparatus according to the present invention. In the figure, the same parts as those in FIG. 1 are designated at the same reference numerals, and detailed description of those parts will be omitted herefrom.

The bulb type high-pressure discharge lamp according to the present embodiment comprises a high-pressure lamp device 11, a discharge lamp lighting device 12, a power-receiver means 13 and a case 14. The high-pressure discharge lamp device 11 includes a high-pressure lamp 11*a* and a reflector 11*b*. Although this high-pressure discharge lamp 11*a* uses a high-pressure discharge lamp according to the present invention, the lamp shown in FIG. 4 is particularly preferred in this case.

The reflector 11*b* includes a light-projection opening 11*b*1, a reflecting surface 11*b*2 and a top opening 11*b*3. The small-diameter cylindrical section 1*b* in the top side is fixed to the top opening 11*b*3 with an inorganic adhesive 11*c*, thereby supporting the high-pressure discharge lamp 11*a*, in a manner that the bulging section of the high-pressure discharge lamp 11*a* substantially corresponds to the focus of the reflector 11*b*. Since the small-diameter cylindrical section 1*b*' of the light-transmitting ceramic discharge vessel provided in the high-pressure discharge lamp does not project forward from the light-projection opening 11*b*1 of the reflector 11*b*, light distribution is not disturbed.

The discharge lamp lighting device 12 includes a high frequency inverter and a current limiter means, and lights the high-pressure discharge lamp 11*a*. The discharge lamp lighting device 12 is provided in the back side of the reflector 11*b* of the high-pressure discharge lamp 11*a*. The heat caused by lighting of the high-pressure discharge lamp 11*a* is shielded by the reflector 11*b* so that the discharge lamp lighting device 12 operates stably.

The power-receiver means 13 is formed of a screw base and receives electricity thereby energizing the discharge lamp lighting device 12, when the screw base is attached to a lamp socket (not shown).

Although the case 14 stores the structural elements described above to hold them at predetermined positions, the case 14 has a streamlined part which increases its applicability to lighting devices such as a down light and the like.

According to the present invention, there is provided a small, high-pressure discharge lamp which starts operation easily, allows easy transition from glow discharge to arc discharge, and prevents blackening of the light-transmitting ceramic discharge vessel caused by sputtering.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A high-pressure discharge lamp characterized by comprising:

a light-transmitting ceramic discharge vessel having an internal volume of 0.1 cc or less and including a bulging section and small-diameter cylindrical sections communicating with both ends of the bulging section, said bulging section having both ends narrowed by a continuous curved surface, and said small-diameter cylindrical sections having an inner diameter smaller than the bulging section;

power-supplying conductors each including a seal part and a halide-resistant section having a proximal end connected to a distal end of the seal part and inserted respectively in the small-diameter cylindrical sections of the light-transmitting ceramic discharge vessel, each of the halide-resistant sections forming a slight gap to the inner surface of the small-diameter cylindrical section;

a pair of electrodes respectively arranged at the distal ends of one halide-resistant parts and located in the bulging section of the light-transmitting ceramic discharge vessel, with a distance d1 of 1.0 mm or above maintained between each of distal ends of the electrodes and the inner surface of the light-transmitting ceramic discharge vessel on a plane perpendicular to an axis of the light-transmitting ceramic discharge vessel including the distal ends of the electrodes;

seals made of ceramic-sealing compound respectively making sealing between the small-diameter cylindrical sections of the light-transmitting ceramic discharge vessel and the seal parts of the power-supplying conductors; and a discharge medium containing metallic halide and filled in the light-transmitting ceramic discharge vessel.

2. A high-pressure discharge lamp according to claim 1, characterized in that the distance d1 between each of distal ends of the electrodes and the inner surface of the light-transmitting ceramic discharge vessel on a plane perpendicular to an axis of the light-transmitting ceramic discharge vessel including the distal ends of the electrodes is 1.2 mm or more.

3. A high-pressure discharge lamp characterized by comprising:

a light-transmitting ceramic discharge vessel having an internal volume of 0.1 cc or less and including a bulging section and small-diameter cylindrical sections communicating with both ends of the bulging section, said bulging section having both ends narrowed by a continuous curved surface, and said small-diameter cylindrical sections having an inner diameter smaller than the bulging section;

power-supplying conductors each including a seal part and a halide-resistant section having a proximal end connected to a distal end of the seal part and inserted respectively in the small-diameter cylindrical sections of the light-transmitting ceramic discharge vessel, each of the halide-resistant sections forming a slight gap to the inner surface of the small-diameter cylindrical section;

a pair of electrodes respectively arranged at the distal ends of one halide-resistant parts and having distal ends projected by 1.2 mm or more into the bulging section of the light-transmitting ceramic discharge vessel, with a distance d1 of 1.0 mm or more maintained between each of distal ends of the electrodes and the inner surface of the light-transmitting ceramic discharge vessel on a plane perpendicular to an axis of the light-transmitting ceramic discharge vessel including the distal ends of the electrodes;

seals made of ceramic-sealing compound respectively making sealing between the small-diameter cylindrical sections of the light-transmitting ceramic discharge vessel and the seal parts of the power-supplying conductors; and a discharge medium containing metallic halide and filled in the light-transmitting ceramic discharge vessel.

4. A high-pressure discharge lamp according to any one of claims 1, 2 or 3, characterized in that the light-transmitting ceramic discharge vessel has an internal volume of 0.05 cc or less.

5. A lighting apparatus characterized by comprising:

a main body; and the high-pressure discharge lamp supported by the main body according to any one of claims 1, 2 or 3.

6. A lighting apparatus characterized by comprising:

a main body; and the high-pressure discharge lamp supported by the main body, according to claim 4.

* * * * *